United States Patent [19]

Krimmel

[11] 4,209,704

[45] Jun. 24, 1980

[54] TANDEM ION ACCELERATION HAVING A MATTER-FREE ION CHARGE REVERSED ZONE

[75] Inventor: Eberhard F. Krimmel, Pullach, Fed. Rep. of Germany

[73] Assignee: Siemens Aktiengesellschaft, Berlin & Munich, Fed. Rep. of Germany

[21] Appl. No.: 933,411

[22] Filed: Aug. 14, 1978

[30] Foreign Application Priority Data

Aug. 25, 1977 [DE] Fed. Rep. of Germany ..... 2738405

[51] Int. Cl.[2] ..... H01J 27/00

[52] U.S. Cl. ..... 250/423 R; 250/423 P; 250/492 A

[58] Field of Search ..... 250/423 P, 423 R, 391, 250/492 A, 281, 282; 313/359

[56] References Cited

U.S. PATENT DOCUMENTS

| | | | |
|---|---|---|---|
| 2,816,243 | 12/1957 | Herb et al. | 250/423 R |
| 3,914,655 | 10/1975 | Dreyfus et al. | 250/423 P |

*Primary Examiner*—Bruce C. Anderson

*Attorney, Agent, or Firm*—Hill, Van Santen, Steadman, Chiara & Simpson

[57] ABSTRACT

A tandem ion accelerator is disclosed having a charge reversing device for recharging negative ions into positive ions. The recharging is carried out in a matter-free zone and a light source is provided having a high luminous density for recharging the negative ions into positive ions. Preferably a deflecting device is provided for displacing an ion path and the light source is arranged such that a path of the light emitted from the light source coincides at least with a portion of the ion path.

9 Claims, 2 Drawing Figures

TANDEM ION ACCELERATION HAVING A MATTER-FREE ION CHARGE REVERSED ZONE

BACKGROUND OF THE INVENTION

The invention relates to a tandem ion accelerator having a matter-free ion charge reversal zone.

To a rapidly increasing extent, in research and also in industry, high-speed i.e. high-energy ions are being used for doping solid bodies with foreign elements for use in medicine and for the investigation of reactions between energy particles in various states of aggregation etc. In accordance with the current prior art, high-speed ions are mainly obtained via linear accelerators, ring accelerators and electron ring accelerators.

In industry, in the medium energy range, linear accelerators are mainly employed in the field of ion implantation. Simple linear accelerators, for example, operating in accordance with the Van de Graaff principle, are used most frequently. These accelerators consist of a simple, one-element or multi-element acceleration path. Generally the ion source carries high voltage, the object ground potential, and the mass separator carries either ground potential or high voltage. Other more complicated modes of operation have not been adopted.

If acceleration voltages in the MeV range are required, the components connected to high voltage and the acceleration path are operated in high pressure tanks in order to considerably reduce the large safety clearances with respect to sparkovers which are usually required at atmospheric pressure and which are intolerable. The disadvantage is accepted that the ion source, which requires frequent servicing, can only be reached with great expense. An often desirable preliminary decomposition of the ion beam is likewise virtually impossible. High current ion sources are therefore not currently used in systems of this kind.

The problem that the sensitive components of an acceleration system are connected to high voltage and arranged in a pressure tank can be avoided by means of tandem accelerators. In a tandem accelerator, an injector (ion source and mass separator) connected to ground potential emits negative ions into an acceleration path, whose end thus carries high voltage. In the adjoining gas or solid body target these negative ions are reversed in charge to form positive ions as a result of collisions with the target atoms through the withdrawal of electrons. In a second adjoining acceleration path whose end now carries ground potential, the now positive ions are again accelerated and thus obtain double energy. The ions can again be separated. The irradiation object is connected to ground.

A disadvantage of this arrangement consists in that the yield of negative ions at the injector output is low and that the interaction between the negative ions and the charge reversal target produces different positive charge states with an energy spread in comparison to the oncoming beam and with an increase in the beam divergence. This means a reduction in the beam intensity. Therefore in many respects tandem accelerators are to be preferred to simple accelerators, but on the other hand they supply only low ion currents.

Further disadvantages of conventional tandem accelerators result from the fact that the interaction between the originally negative ions and the neutral or charged atoms or molecules of the matter of the charge reversed target results in a distribution between the various possible positive charge states. Therefore in practice one is generally left with a single-energy particle beam, and must consequently filter ions of one single charge state out of the ions of different charge states. The filtering process reduces the ion yield. The interaction of the ions in the charge reversal target gives rise to scatter processes so that the particles are deflected from their original path. This results in a spread of the original bunch of beams. This spread likewise reduces the beam intensity. Under certain circumstances the normal widening of the ion energy caused by the scatter process can also prove disturbing. Fixed charge reversal targets consist of thin foils which rapidly become unserviceable so that the pressure chamber must frequently be opened in order to exchange the foils. Gas targets involve vacuum problems, i.e. evacuation problems also manifest by the undesired formation of intensive x-rays produced by the secondary electrons.

SUMMARY OF THE INVENTION

An object of the invention is to provide a tandem accelerator having a charge reversal zone in which there are produced fundamentally only ions of a positive, freely selectable charge state with a bundle of ion beams of low divergence.

This object is realized by a tandem accelerator having a device for recharging negative ions into positive ions and wherein the zone in which the recharging is carried out is matter-free. A light source is provided in the charge reversing device and which has a high luminous density for recharging the negative ions into positive ions.

In accordance with the invention, the previously mentioned disadvantages of the formation of different charge states, of beam spreading, etc. are avoided in that the recharging zone remains matter-free and the negative ions are reversed in charge by being optically excited as a result of the absorption of electro-magnetic radiation with frequencies preferably in the associated resonance states. The source of the electro-magnetic beams preferably consists of lasers as these allow a particularly high irradiation density to be achieved in the recharging range. By using one or more than one laser of suitable emission frequency a desired special charge state with a high quota can then be used in accordance with the excitation probability of the ions. The advantage of using electromagnetic radiation for charge reversal purposes consists in that the lasers used as light sources can be located outside of the pressure tank and can thus carry ground potential. The electromagnetic radiation is fed to the charge reversal zone through windows and via reflectors.

In the following the tandem ion accelerator corresponding to the invention and its mode of operation will be explained in detail in the form of a preferred embodiment illustrated in the FIGS.

DESCRIPTION OF THE PREFERRED EMBODIMENTS

Figure 1:
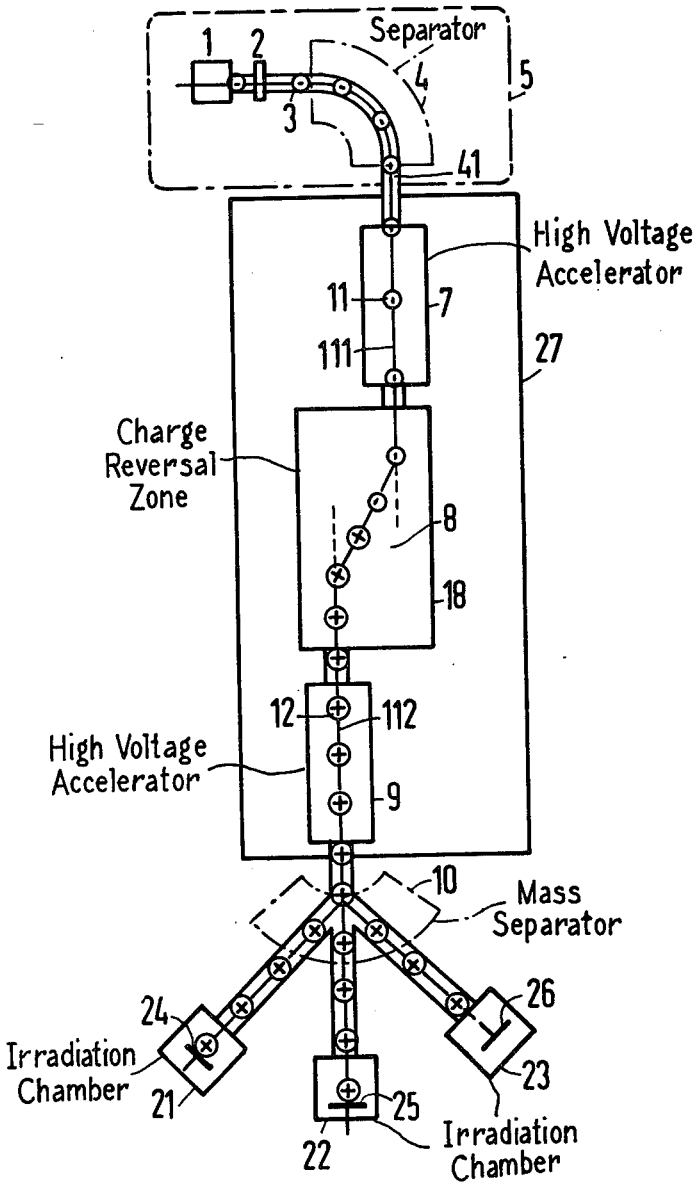
FIG. 1 schematically illustrates the general construction of the tandem ion accelerator.

An ion source 1 for negative ions is connected to an extraction system 2 which serves to extract and accelerate negative ions to energies of a few keV, e.g. 20 keV. The output 3 of the extraction system 2 carries ground potential, and accordingly the ion source carries negative potential. This potential is sufficiently low to avoid special measures such as, for example, a pressure tank. The ion source is also easily accessible. The output 3 of the extraction system 2 is directly adjoined by a separator 4 which carries ground potential and which, for example, consists of a magnetic mass separator. These aforementioned components 1 to 4 are surrounded by a grounded housing 5 for protection from contact. The components 1 to 5 will also be referred to together as an injector hereafter. The injector is connected to a first high voltage acceleration path 7 which serves to accelerate negative ions. The first acceleration path 7 is adjoined by a charge reversed zone 8 in which negative ions are reversed in charge to form positive ions. This zone 8 lies inside a tube 18 which carries the same potential as the outlet electrode of the first acceleration path and the input electrode of the second acceleration path. Thus the tube 18 likewise carries a high positive voltage, e.g. 3 MeV. This charge reversal zone 8 is followed by a second high voltage acceleration path 9 for positive ions. The output of this second acceleration path 9 likewise carries ground potential. The second acceleration path 9 is adjoined by a mass separator 10 which simultaneously serves as an ion switch. The beam of positive ions formed in this way strikes the objects 24, 25 and 26 which are to be irradiated and are arranged in various irradiation chambers 21, 22, 23. The acceleration path 7, the charge reversal zone 8 and the second acceleration path 9 are installed in a high pressure tank 27 in order to reduce the sparkover clearances. This high pressure tank 27 is filled, for example, with $SF_6$ at a pressure of 20 bar. The high vacuum pumps required to evacuate the injector of the acceleration paths 7 and 8 and of the irradiation chambers 21 and 23 have not been shown. The axis of the beam of the negative ions is referenced 111 and that of the positive ions 112.

Figure 2:
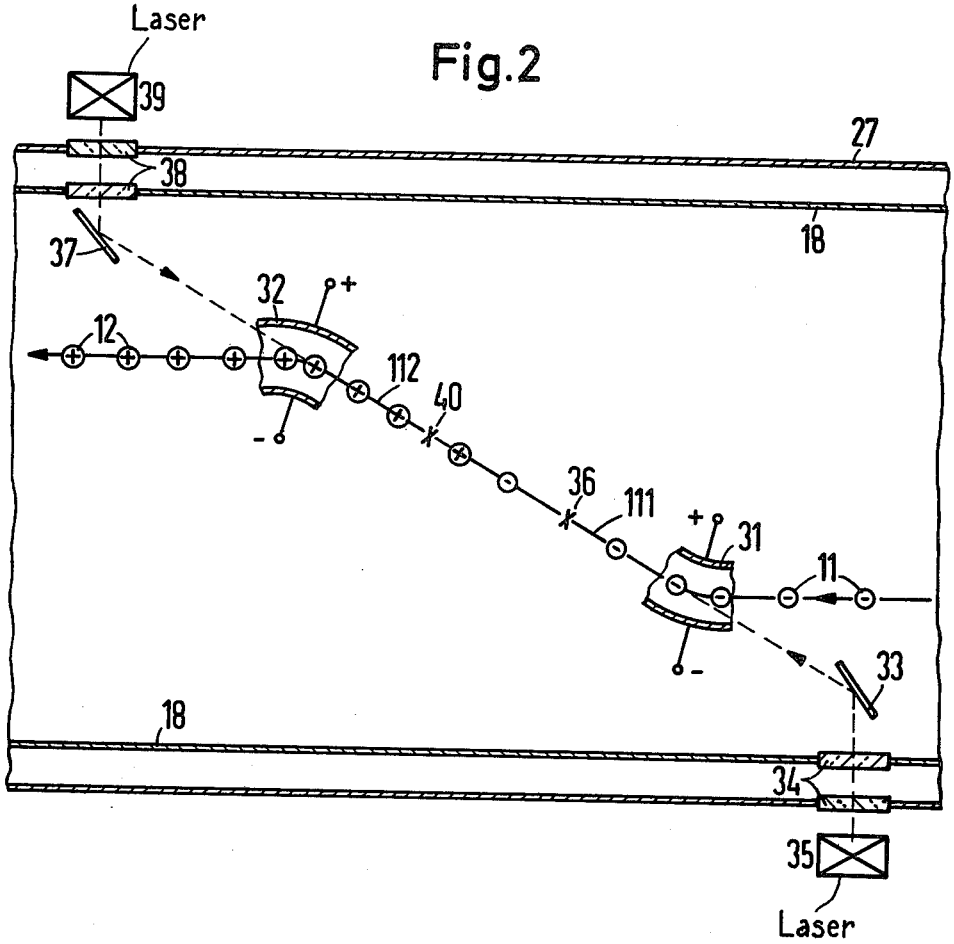
FIG. 2 illustrates the recharging zone which is a portion of the tandem ion accelerator and which is explained with reference to FIG. 1.

In FIG. 2, the direction of the beam of negative ions 11 and that of the beam of positive ions 12 are indicated by arrows. A deflecting capacitor for the beam 111 is referenced 31 and a deflecting capacitor for the beam 112 of positive ions is referenced 32. The deflecting capacitor 32 simultaneously serves to preliminarily break down the mass and charge of the beam 12 of positive ions. When two lasers are used as light sources, windows 34 and 38 are provided through which the laser light can emerge from the laser light sources 35 and 39 into the interior of the charge reversal path 8. The bundles of laser light are coaxially aligned by the deflecting reflectors 33 and 37 onto the ion beam axis 111, 112 between the deflecting condensers 31 and 32. The associated focal points are referenced 36 and 40.

Negative ions 11 are produced in the ion source 1, withdrawn from the source 1 by the extraction system 2, and focused onto the outlet gap 41 of the mass separator 4. The magnetic field of the mass separator 4 is selected to be such that only the desired type of ions 11 passes through the outlet gap 41. In the high voltage acceleration path 7 containing the voltage U, the negative ions 11 of the charge n are brought to the energy $E_n = neU$ where n is an integer, e is the elementary charge and U is the acceleration voltage. In the charge reversal zone 8, the ions 11 are deflected by the deflecting capacitor 31 so that the bundle of laser light emitted from the laser light source 35 can be guided via the reflector 33 along the ion beam axis between the deflecting capacitors 31 and 32. The frequency $\nu$ of the laser light is selected to be such that the ion is excited and is consequently recharged. If full recharging to a desired positive ion charge state requires a plurality of individual excitation processes, these processes are effected by further laser source systems corresponding to that described above. By way of example, a second system (39, 38, 37) is illustrated in FIG. 2. The ions 12 which have been brought to a positive charge and which have the charge me (m=integer) are brought by the deflecting capacitor 32 to the final path, are again accelerated in the second acceleration path 9 so that they finally pass through the mass separator 10 carrying ground potential, with the energy $E=(n+m)eU$ and, depending upon the selection of the latter's magnetic field, strike one of the objects 24, 25 or 26. Deflecting magnets can also be used in place of deflecting capacitors 31 and 32.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A tandem ion accelerator comprising:
(a) an ion source and separator;
(b) a high pressure enclosure having a first high voltage acceleration means, a charge reversal means, and a second high voltage accelerator all series connected in the pressure enclosure and receiving ions from the ion source;
(c) said charge reversal means comprising means for providing a matter-free zone in which the charge reversal is carried out, light source means having a high luminous density for recharging the ions, and deflecting means for deflecting a path of the ions; and
(d) mass separator means connected to the second high voltage accelerator.

2. A tandem accelerator as claimed in claim 1 in which the light source means provides an emission with a quantum energy which corresponds to an excitation energy of the ions.

3. A tandem ion accelerator as claimed in claim 1 wherein the light source means comprises a laser.

4. A tandem ion accelerator as claimed in claim 1 in which a deflecting means is provided for displacing an ion path and the light source means is positioned such that a path of light emitted from the light source means coincides at least with a portion of the ion path.

5. A tandem ion accelerator as claimed in claim 4 in which the deflecting means comprises a capacitor.

6. A tandem ion accelerator as claimed in claim 4 in which the deflecting means comprises an electro-magnet.

7. A tandem ion accelerator as claimed in claim 4 in which a plurality of deflecting means and a corresponding number of light source means are provided along the ion path.

8. A tandem ion accelerator as claimed in claim 4 the light emitted from the light source means is focused at a point-like zone arranged in the ion path.

9. A tandem ion accelerator of claim 2 in which the quantum energy of the emission of the light source means is equal to an excitation energy of the ions.

* * * * *